United States Patent [19]

Eberhardt

[11] Patent Number: 4,471,756

[45] Date of Patent: Sep. 18, 1984

[54] AIR SUPPLY DISTRIBUTOR FOR FIREPLACES

[76] Inventor: H. Alfred Eberhardt, 1630 Harvard La., Paoli, Pa. 19301

[21] Appl. No.: 34,424

[22] Filed: Apr. 30, 1979

[51] Int. Cl.[3] ..... F24B 13/02; F24B 1/18

[52] U.S. Cl. ..... 126/143; 126/120

[58] Field of Search ..... 126/143, 121, 120, 242, 126/279, 163 R, 336; 237/51

[56] References Cited

U.S. PATENT DOCUMENTS

| | | | |
|---|---|---|---|
| 2,375,318 | 5/1945 | Mudgett | 126/121 |
| 2,470,430 | 5/1949 | Carter | 126/120 |
| 2,497,486 | 2/1950 | Barber | 126/120 |
| 2,740,398 | 4/1956 | Collins | 126/242 X |
| 2,819,711 | 1/1958 | Robinson | 126/242 X |
| 4,106,475 | 8/1978 | Mayes | 126/121 |
| 4,136,666 | 1/1979 | Haas | 126/143 |
| 4,182,305 | 1/1980 | Johnson | 126/121 X |
| 4,184,474 | 1/1980 | Pulliam et al. | 126/121 |
| 4,216,761 | 8/1980 | Stegmeier | 126/120 |

FOREIGN PATENT DOCUMENTS

| | | | |
|---|---|---|---|
| 2227789 | 11/1974 | France | 126/120 |
| 4106 | of 1875 | United Kingdom | 126/120 |
| 464104 | 4/1937 | United Kingdom | 126/163 |
| 744169 | 2/1956 | United Kingdom | 126/143 |

*Primary Examiner*—Randall L. Green

*Attorney, Agent, or Firm*—Frank A. Follmer

[57] ABSTRACT

An air supply distributor for fireplaces having an opening in the hearth for the supply of relatively cold air is used in combination with means, such as a log holder or grate, for supporting combustible products and comprises a pair of side walls and a top cover. The distributor is adapted to be positioned under the log holder or grate to overlie the hearth opening so that relatively cold air passing through the hearth opening is directed toward the front opening of the fireplace from which it passes to the fire for supporting combustion thereof thereby minimizing the amount of air drawn from the room.

9 Claims, 5 Drawing Figures

FIG. 2
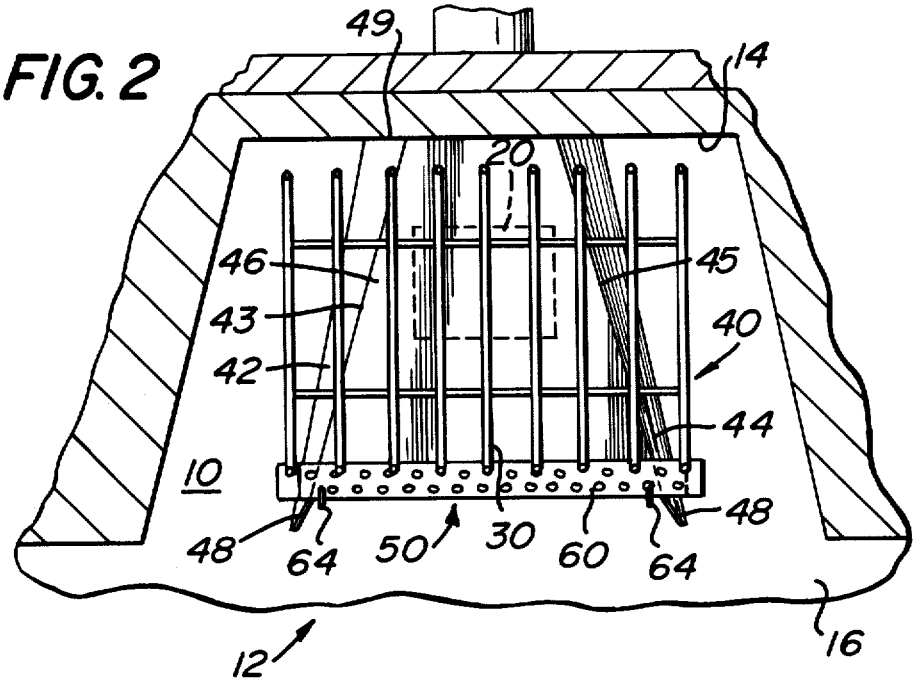
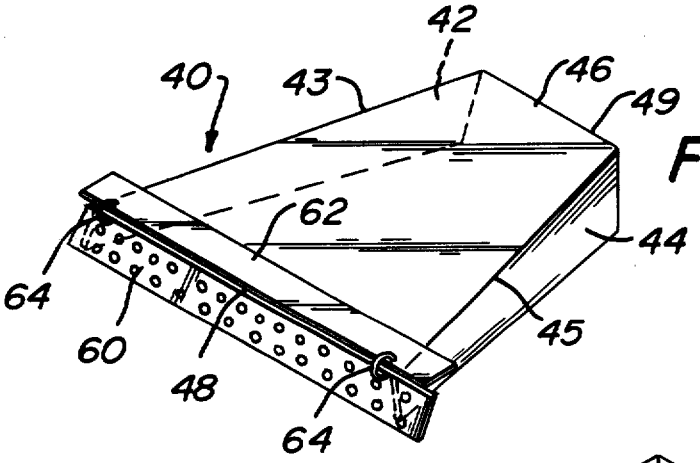
FIG. 4
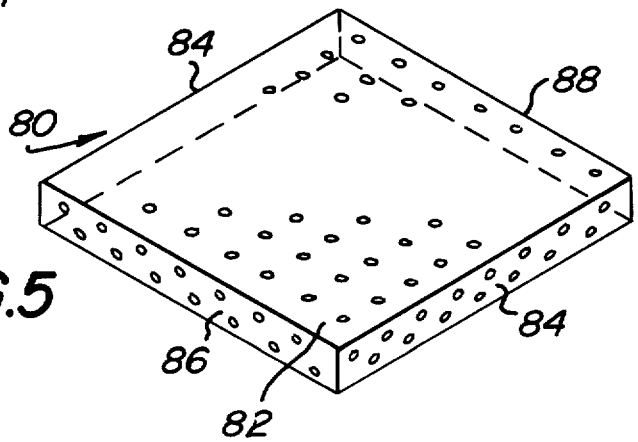
FIG. 5

AIR SUPPLY DISTRIBUTOR FOR FIREPLACES

BACKGROUND AND SUMMARY OF THE INVENTION

Conventional fireplaces are not very effective sources of heat for the room in which they are located. The main reason for this inefficiency is that the fire draws heated air from the room and large amounts of outside air into the house to meet the combustion requirements of the fire. This causes drafts of cold air along the floor of the room and the cooling of the house.

It is the general object of the invention to provide an air supply distributor for fireplaces designed so that the fireplace can be operated in a manner to minimize the amount of air drawn from the room to feed the fire and to increase the efficiency of the fire in heating the room.

Briefly stated, the air supply distributor in accordance with the invention is adapted for use with a fireplace provided with means for supplying relatively cold air to an opening in the hearth of the fireplace. The air supply means may comprise a flow passageway including the ash pit opening in the hearth with the air being supplied from the basement or other house area whereby relatively cold air is supplied to the fire. Alternatively, the ash pit opening may be supplied air from the outside of the house by way of suitable ductwork or other passageway means connected through a vent to the outside.

The air flow distributor of the invention is adapted to be positioned beneath the support for the combustible products and to overlie the hearth opening. The distributor comprises a pair of side walls extending from the back wall of the combustion chamber of the fireplace toward the front opening thereof and a top cover extending across the hearth between the side walls and spaced from the combustible products support. An air flow discharge opening is defined by the front edges of the side walls and top cover of the distributor and is located to face the front opening of the combustion chamber of the fireplace. The distributor is constructed and arranged to be positioned in an air flow distributing position to direct the flow of air passing through the hearth opening toward the front opening of the combustion chamber for discharge through the discharge opening from which the air passes to the fire to meet the combustion requirements thereof and upwardly through the chimney flue.

By reason of the above described arrangement, relatively cold air is supplied to the fire to support the combustion thereof thereby substituting this cold air for the room air which conventional fireplaces utilize to feed the fire. Thus, since the room air is heated by the home's heating system, the use of much less room air to feed the fire results in considerable savings in energy.

By reason of the above-described air distributor of the invention, the air is directed to flow underneath the fire and is delivered into the fireplace at a location forwardly of the fire. This arrangement avoids the danger of a "forging effect" that would occur if the air passing through the hearth opening could pass directly upwardly. The effect would probably result in a burnout of a localized section of the fire and would eventually damage the log holder or fireplace grate or whatever device is used to support the combustible products. In accordance with the invention, the inflow of air from the hearth opening to the fire is properly distributed to avoid this problem.

A further object of the invention is to provide an air distributor design that minimizes the friction loss of the supply air as it flows to the fire, i.e., to provide an air flow path having a minimum of restriction to flow. To this end, the top cover is inclined downwardly from the rear of the fireplace to the front opening thereof.

Another object of the invention is to provide an air flow distributor of the indicated type which can be manufactured in an economical manner.

Another feature of the air distributor of the invention is that it can be made of a relatively light gage sheet material since it does not have to support heavy logs or other combustible products and can be used in conjunction with existing fireplace grates or log holders.

A further feature of the air distributor of the invention is that it is designed so that it can be used with existing fireplaces provided with glass fronts and functions whether the glass doors are open or closed.

It is to be noted that the air flow distributor of the invention will control the air flow in a way to minimize the entrance of room air into the fireplace and also to minimize the passing of smoke out of the fireplace while increasing the heat output of the fireplace by reflecting or directing into the room the radiant energy of a coal bed which accumulates on the inclined top cover of the air distributor.

A further feature of the air distributor of the invention is that it serves to increase the comfort of the room's inhabitants by eliminating cold drafts that normally would accompany the infiltration of make-up air into the room to feed the fire as is the case in conventional fireplaces.

Another type of air distributor in accordance with the invention is constructed in the form of a hood perforated throughout with holes and adapted to be positioned beneath the support for the combustion products to overlie the hearth opening. This type of distributor prevents the "forging effect" described above by dispersing the supply air around the fire and achieves many of the features of the invention discussed heretofore.

Prior art fireplace air control devices are disclosed in U.S. Pat. Nos. 2,375,318; 2,470,430; and 2,819,711.

BRIEF DESCRIPTION OF THE DRAWING

FIG. 2 is a plan view of the fireplace shown in FIG. 1 taken on line 2—2;

FIG. 4 is an isometric view of the distributor; and

FIG. 5 is an isometric view of another form of distributor in accordance with the invention.

DETAILED DESCRIPTION OF THE PREFERRED EMBODIMENT

Figure 1:
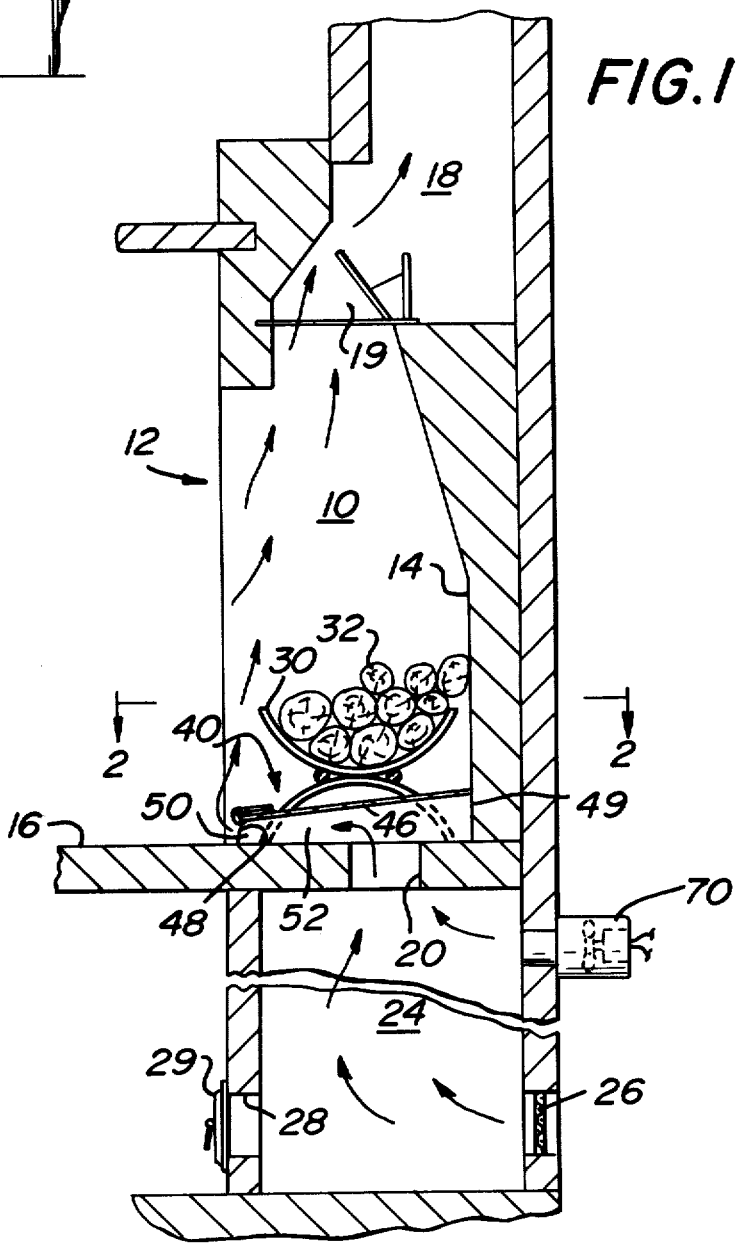
FIG. 1 is a vertical section through a fireplace comprising an air supply distributor in accordance with the invention.

In FIG. 1, there is shown a typical fireplace comprising a combustion chamber 10 having a front opening 12, a back wall 14, a hearth or floor 16 and a chimney flue 18 connected to a portion of the combustion chamber 10 through a damper-controlled throat passage 19 through which the combustion gases are discharged. As is conventional, there may be provided an ash pit opening 20 in hearth 16 leading to an ash pit 24 therebeneath. While it is conventional that the ash pit opening 22 be provided with a door, it is preferable that this door be removed when the fireplace is adapted for use with the air supply distributor in accordance with the invention.

There is provided means for supplying relatively cold air to the hearth opening 20, such means comprising an air intake vent 26 through which outside air may flow into the ash pit 24 for flow therefrom through hearth opening 20 to supply air for the combustion of the fire in the fireplace, this air flow being controlled by the air supply distributor in accordance with the invention as will appear hereafter. As is conventional, there may be provided in a room or basement below the fireplace a trash removal opening 28 provided with a door 29. If desired, the cold air may be supplied to the trash pit 24 by means of this opening 28, in which case trash removal door 29 is placed in an open position.

Figure 3:
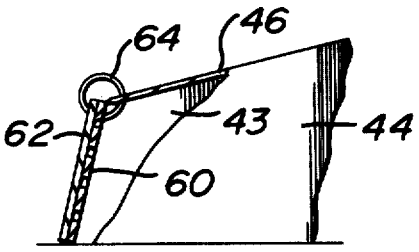
FIG. 3 is an enlarged view of a detail showing the front end of the distributor.

The air supply distributor of the invention is used in combination with some means for supporting logs, coals or other quantity of combustible products in the combustion chamber 10 at a location spaced above the hearth opening 20. As shown in FIGS. 1—3, this means comprises a log holder 30 of a conventional construction and adapted to support a plurality of logs 32 in a position spaced above the hearth 16 and the hearth opening 20. It will be apparent that the combustion products supporting means may take various forms such as a fireplace grate that may be used to support coals or the like.

The air supply distributor of the invention is shown in detail in FIGS. 4–6 and is indicated generally at 40. Distributor 40 comprises a pair of side walls 42 and 44 and a top cover 46 formed from a single sheet of metal bent along two biased break lines 43 and 45. The single sheet forming the top cover and side walls is preferably a medium gage sheet steel with the top cover 46 having its outer sides aluminized (or treated with another suitable coating) for improved heat reflection and its inner sides painted with high temperature flat black paint for improved heat conduction. This combination will maintain a lower metal temperature and contribute to longer life.

As is apparent from the drawings, break lines 43 and 45 are arranged so that side walls 42 and 44 are shorter and spaced apart more at one end (the front end of the distributor 40 in use) than at the other end (the back end of the distributor 40 in use). Also, side walls 42 and 44 form obtuse angles with top cover 46. Accordingly, the front edge 48 of distributor 40 defines a low, wide air flow discharge opening 50. The back edge 49 of distributor 40 is constructed to mate with a vertical back wall of a typical fireplace in a manner to close off flow through the back opening of distributor 40.

In use, distributor 40 is positioned with the back edge 49 against the fireplace back wall 14 and the front edge 48 facing the fireplace front opening 12 so that as air enters a flow distributing chamber 52 defined between the inside of distributor 40 and hearth 16, the air will be directed forwardly for discharge through air flow discharge opening 50 adjacent the fireplace front opening 12. In the operating position of the distributor 40, the back wall 14 of the fireplace closes off flow through the rear opening defined at back edge 49 as is apparent from a consideration of FIG. 1. The design of distributor 40 is such that there is a higher distributor chamber portion towards the rear thereof in the region of the ash pit opening 20 to thereby minimize the air flow friction at the location where the incoming air has to make a right angle turn under top portion 46 in order to move to the discharge opening 50. The incoming cold air impinging on the inside of cover 46 provides a cooling effect contributing to longer life of the distributor.

The distributor 40 may be provided with draft means for controlling the flow of air through the discharge opening 50. Such draft means comprises a pair of draft control plates 60 and 62 hingedly mounted on the distributor 40 at the front end thereof for movement to flow control positions extending across the discharge opening 50. The hinged mounting for plates 60 and 62 comprises two small wire rings 64 engaged loosely in holes in the top cover 46 of the distributor and in holes in the plates 60 and 62 in a manner to permit relative movement therebetween. By reason of this simple hinged mounting arrangement, the plates 60 and 62 can be selectively moved between a position resting on top of the top cover 46 as shown in FIG. 1 to flow control positions extending across the discharge opening 50 of the distributor 40. The plate 60 is perforated with a plurality of holes therein and serves to provide a partial reduction in the flow area at discharge opening 50. Perferably the total hole area or flow area through plate 60 would be about half the flow area of opening 50. The plate 61 is solid and serves to completely close off flow through the discharge opening 50.

The distributor 40 and the plates 60 and 62 are designed for ease of movement of the plates 60 and 62 between their inactive and flow control positions and to support the plates 60 and 62 in such positions. To this end, the front edges of the side walls 42 and 44 extend forwardly beyond the top cover front edge on an angle of about 30° with hearth 16. These inclined front edges of the side walls 42 and 44 serve to support the plates 60 and 62 in their flow controlling positions. The perforated plate 60 is adapted to overlap the front opening slightly at side wall 42 and about an inch at side wall 44. The closure plate 62 is the same size as the perforated plate 60 but is mounted to overlap all the active holes of the perforated plate 60 and to extend about an inch beyond the perforated plate 60 at the side wall 42. By this arrangement, the plates 60 and 62 can be selectively placed in either their flow controlling or inactive positions by engagement with the projecting ends thereof with typical fireplace utensils or the like.

The use of the air supply distributor of the invention as installed in a conventional fireplace as shown in FIGS. 1–3 will now be described. The fireplace is provided with an opening 20 in the hearth 16 supplied with cold air either from the outside through vent 26, from a basement or the like through the ash removal opening 28, or from a small fan 70 arranged to deliver ducted outside air to ash pit 24. The distributor 40 is placed on the hearth 16 of the fireplace over the ash pit opening 20 with the rear end pushed up against the back wall 14 of the fireplace and plates 60 and 62 in their inactive position on top cover 46. The log holder 30 is placed and centered in a position to straddle the distributor 40 and to extend in spaced apart relation thereover. The logs 32 are placed on the log holder and the fire is started. Once the fire is burning, cold air will be drawn into the ash pit 24 and will flow up through the ash pit opening 20 into the distributor chamber 52. The distributor 40 both heats and deflects the incoming cold air forwardly through the front discharge opening 50 from which the air flows upwardly as shown by the arrows in FIG. 1. It is noted that this arrangement in effect provides a chimney under the fire bed in addition to the chimney 18 over the fire bed. It also helps to negate the amount of vacuum in the room created by combustion. The air supply then makes a turn upwardly and backwardly toward the fire bed and the chimney flue entrance 19 as shown by the arrows in FIG. 1. The flow of this denser cool air current displaces and discourages the entrance of air from the room containing the fireplace into the fireplace itself. This, of course, provides a considerable energy savings especially during very cold weather since the use of room air will cause the replacement of this air by outside air which must then subsequently be reheated by the heating system of the home.

The amount of draft may be varied by the positioning of the perforated plate 60 in its flow control position. Thus, to provide for the maximum air flow, the plates 60 and 62 are positioned as shown in FIG. 1 on top of the cover plate 46 so as to leave the discharge opening 50 completely open. In order to operate at a reduced air flow, the perforated plate is moved into the flow control position extending across the front end of the distributor 40. If desired, the opening 50 may be completely closed by moving solid plate 62 to its flow control position. This would be done when the fireplace is not in use.

It is noted that during the burning of the fire, coals will drop from the fire onto the top of the top cover 46 of the distributor 40. These coals will be exposed to the inhabitants of the room to thereby provide a substantial amount of radiant heat by reason of the inclined support for these coals on top of the top cover portion of the distributor 40.

It will be apparent that various changes can be made in the construction and arrangement of the distributor 40 without departing from the scope of the invention. Thus, the distributor may be made of various sizes to be adapted to various types of fireplaces and log holders. Furthermore, the distributor may be incorporated as a unit with a log holder. Still another arrangement may combine the distributor with a circulating type grate or firebox with glass doors.

It will be evident that the air supply distributor of the invention provides a substantial advance in the art and has many advantages and features over the prior art. Firstly, the arrangement whereby cold air may be supplied in a manner to minimize the use of room air provides for fuel savings and helps prevent smoke from flowing into the room and cuts down on drafts in the room. Secondly, the design of the invention prevents the occurence of a forging effect on the log holder. Also the distributor of the invention may be retrofitted into any existing fireplace. The construction whereby the distributor provides an inclined support for the fire bed results in more radiant heat being directed to the room. Morover, the distributor can be used with existing log holders and is especially adaptable to fireplaces having glass fronts. Also the construction provides a convenient support for a lighting element which may be positioned on top of the top cover of the distributor underneath the logs. Also, when used with a glass front type of fireplace, the flue can, in effect, be more conveniently closed by simply closing the front discharge opening 50 of the distributor 40 by means of solid plate 62.

In FIG. 5 there is shown a distributor 80 comprising an alternate form of the invention. Distributor 80 consists of a perforated sheet of metal folded along four crease lines, perferably arranged in a square, to form a hood-like configuration comprising a top cover 82, a pair of side walls 84, a front wall 86 and a rear wall 88. As shown in FIG. 5, the perforations or openings 90 are distributed throughout the surface of distributor 80. Distributor 80 is adapted to be positioned with its walls 84–88 resting on the hearth 16 and top cover 82 beneath the log holder 30 so as to enclose ash pit opening 20. In this manner distributor 80 defines an air distributor chamber receiving the air flowing upwardly through ash pit opening 20 and disperses this air through perforations 90 around the fire in the log holder 30 thereabove. Thus distributor 80 protects the fire and the log holder from any "forging effect" and provides many of the advantages of the distributor 40 described above.

I claim:

1. For use with a fireplace comprising a combustion chamber having a front opening and a back wall, a chimney flue connected to a top portion of the combustion chamber for discharging combustion gases therefrom, a hearth, an opening in the hearth, and means for supplying relatively cold air to the opening in the hearth, the combination comprising:

means for supporting a quantity of solid combustible products in the combustion chamber in a location spaced above said hearth and said hearth opening, and an air flow distributor adapted to be positioned in an air flow distributing position beneath said combustible products support and overlying said hearth opening, said distributor comprising a top cover and side walls defining an air distributing chamber for receiving the flow of air passing upwardly through said hearth opening, said top cover extending across the hearth above said hearth opening and spaced below said combustion products support to redirect the flow of air passing upwardly through said hearth opening so that substantial amounts of air flow laterally along the hearth before being discharged from said air distributing chamber to flow to said combustion chamber, said top cover being inclined downwardly from the back of the fireplace toward the front opening thereof in an arrangement to provide a larger distributing chamber portion towards the rear thereof in the region of said hearth opening to minimize the air flow friction at the location where the supply air enters the distributing chamber from the hearth opening and is redirected toward the front opening.

2. The combination according to claim 1 wherein said distributor comprises a pair of side walls extending from the back wall of the combustion chamber toward the front opening thereof, said top cover extending across the hearth between said side walls, the front edges of said side walls and said top cover defining an air flow discharge opening for said distributor facing the combustion chamber front opening, said distributor being constructed and arranged in said air flow distributing position to direct the flow of air passing through said hearth opening toward said combustion chamber front opening for discharge through said discharge opening.

3. The combination according to claim 2 wherein said top cover and said side walls are formed from a single sheet of metal bent on two biased break lines.

4. The combination according to claim 2 including draft means for controlling the flow of air through the discharge opening of said distributor, said draft means comprising a plate hingedly mounted on said air distributor for movement to a position extending across the discharge opening.

5. The combination according to claim 4 wherein said plate is provided with a plurality of openings for regulating the flow of air through said discharge opening.

6. The combination according to claim 5 including a second plate hingedly mounted on said air distributor for movement to a position to enclose the discharge opening thereof and to overlie said first-mentioned plate and close the openings in such first-mentioned plate.

7. The combination according to claim 6 wherein said hinged connection for said plates comprises a ring means engaged in holes in said plates and said top cover.

8. The combination according to claim 4 wherein said hearth opening comprises the ash pit opening for the fireplace.

9. The combination according to claim 8 wherein said hearth opening is connected to passageway means communicating with the outside of the building containing the fireplace and including fan means connected in said passageway means.

* * * * *